United States Patent [19]

Lavigne et al.

[11] Patent Number: 4,609,795

[45] Date of Patent: Sep. 2, 1986

[54] VIBRATION PROTECTED SWITCH

[75] Inventors: Vernon W. Lavigne, Rolling Meadows; Keith A. Rosborough, LaGrange; Frederick L. Lau, Skokie, all of Ill.

[73] Assignee: Switchcraft, Inc., Chicago, Ill.

[21] Appl. No.: 649,649

[22] Filed: Sep. 12, 1984

[51] Int. Cl.[4] ..... H01H 3/12

[52] U.S. Cl. ..... 200/61.19; 200/153 M; 200/159 A; 200/288

[58] Field of Search ..... 200/159 A, 159 R, 153 LA, 200/153 M, 314, 288, 61.19, 149 R, 340, 301, 151

[56] References Cited

U.S. PATENT DOCUMENTS

| | | | |
|---|---|---|---|
| 2,153,396 | 4/1939 | Sambleson | 200/151 |
| 3,168,627 | 2/1965 | Gilley | 335/14 X |
| 3,386,061 | 5/1968 | Delafrange | 337/68 |
| 4,419,555 | 12/1983 | Kim | 200/314 |
| 4,429,201 | 1/1984 | Dekkers et al. | 200/159 A |

*Primary Examiner*—A. D. Pellinen

*Assistant Examiner*—Morris Ginsburg

*Attorney, Agent, or Firm*—John T. Meaney; R. M. Sharkansky

[57] ABSTRACT

An electrical switch comprising a moveable contact member resiliently biased to have an electrical contact portion thereof urged into spaced relationship with an electrical contact portion of a fixed member to open the switch and to have another protruding portion thereof disposed for pressure engagement with a cam surface of a reciprocally moveable actuator to urge the electrical contact portions of the contact member into electrical engagement with one another for closing the switch, and a dielectric barrier member carried on the actuator in predetermined positional relationship with the cam surface for movement out of a position between the electrical contact portions, before the switch is closed, to permit the electrical engagement of the contact portions with one another and for movement back into the position between the electrical contact portions, after the switch is open, to prevent the undesired effects of contact bounce.

5 Claims, 4 Drawing Figures

VIBRATION PROTECTED SWITCH

BACKGROUND OF THE INVENTION

An electrical switch of the miniature type, such as a keyboard switch, for example, may comprise a dielectric housing having therein a movable contact member disposed in spaced relationship with a fixed contact member. The movable and the fixed contact members may be connected to respective electrical terminals which protrude outwardly of the housing for connection to respective portions of an electrical circuit, such as a digital pulse detector circuit, for example. Thus, depression of a typewriter-like key attached to the movable contact member causes it to move into momentary electrical engagement with the fixed contact member and produce a corresponding electrical pulse which is detected by the connected circuit.

In practice, it may be found that sudden release of the typewriter-like key and resulting movement of the movable contact member out of electrical engagement with the fixed contact member causes an undesirable vibration of the movable contact member. As a result, the movable contact member may again contact the fixed contact member, a condition generally referred to as "contact bounce", which produces a spurious electrical pulse. This spurious electrical pulse may be detected by the connected circuit as a sequential depression of the typewriter-like key to produce an intentional electrical pulse. Consequently, erroneous electrical data will be delivered to the connected circuit and may cause connected electrical equipment to function erratically.

Attempts have been made in the prior art to correct the problem of "contact bounce" by providing an electrical switch with a dielectric member which is disposed between the contact members of the switch in the "open" condition. However, in these prior art switches, the dielectric member generally is forced between the contact members to open the switch and to maintain the contact members in insulated spaced relationship with one another. Consequently, when the dielectric member is forced between the contact members, the resulting forceful rubbing engagement may cause excessive wear and possibly breakdown of the dielectric member. Furthermore, when the dielectric member is forcefully removed from between the contact members to permit the switch to close, the resulting rubbing of the dielectric member adds to the excessive wearing away and possibility of breakdown of the dielectric member.

SUMMARY OF THE INVENTION

These and other disadvantages of the prior art are overcome by this invention providing an electrical switch comprised of a resiliently movable contact member disposed for movement into and out of electrical engagement with a fixed contact member, and an actuator carrying switch operative cam means in predetermined positional relationship with a dielectric barrier means. This predetermined positional relationship ensures that the dielectric barrier means is removed from between the contact members prior to the cam means exerting sufficient pressure on the resiliently movable contact member to move it into electrical engagement with the fixed contact member and close the switch. Also, the aforesaid predetermined positional relationship ensures that when the cam means removes sufficient pressure from the resiliently movable member to permit it to move away from the fixed contact and open the switch, the dielectric barrier means is moved back into the position between the contact members before "contact bounce" can occur.

Thus, in the operation of this novel electrical switch not only is the problem of "contact bounce" avoided but also the problem of forceful rubbing causing excessive wear and possible breakdown of the dielectric means. Consequently, the dielectric barrier means need not comprise a rugged member for resisting the forceful rubbing engagement encountered in the operation of prior art switches, but rather may comprise a relatively thin wafer-type member having sufficient thickness of dielectric material positionable between the contact members for electrically insulating them from one another when the switch is open.

BRIEF DESCRIPTION OF THE DRAWING

For a better understanding of the invention, reference is made in the following detailed description to the accompanying drawing wherein.

DESCRIPTION OF THE PREFERRED EMBODIMENT

Figure 1:
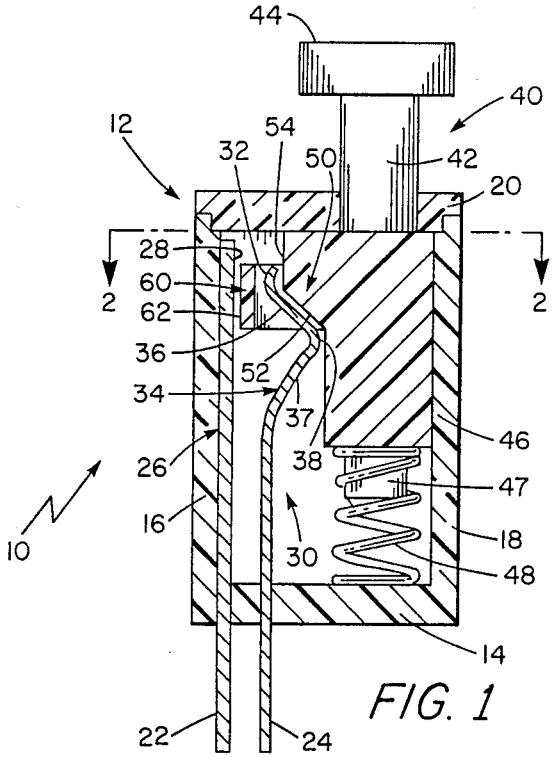
FIG. 1 is an elevational view, partly in section, of a pushbutton electrical switch embodying the invention and disposed in a normally open condition.
Figure 2:
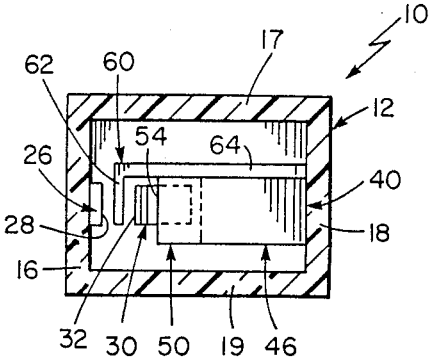
FIG. 2 is a transverse sectional view taken along the line 2—2 shown in FIG. 1 and looking in the direction of the arrows.

Referring to the drawing wherein like characters of reference designate like parts throughout the several views, FIGS. 1 and 2 show a pushbutton type of electrical switch 10 comprising a hollow box-like enclosure or housing 12 made of rigid dielectric material, such as a molded thermoplastic material, for example. The housing 12 includes a bottom wall 14, four orthogonal side walls, 16, 17, 18 and 19, respectively, and a top wall 20 which also may serve as a cover for the enclosure. An external pair of mutually spaced terminals, 22 and 24, respectively, are made of suitable electrically conductive material, such as copper alloy material, for example, and extend insulatingly through the bottom wall 14 of housing 12.

Within housing 12, the terminal 22 is integrally connected adjacent bottom wall 14 to a proximal end portion of a fixed contact member 26 which is made of electrically conductive material, such as beryllium copper, for example. In a a direction extending inwardly of housing 12 from side wall 16, the material of contact member 26 is provided with sufficient thickness, such as about twenty-five thousandths of an inch, for example, to maintain the member 26 in rigid elevational extension along the inner surface of side wall 16 and toward the top wall 20 of housing 12. The fixed contact member 26 also may be maintained in the described rigid attitude by additional conventional means, such as press-fitting the member 26 in an elevationally extending slot (not shown) which is molded into the inner surface of side wall 16, for example. Adjacent the top wall 20, fixed contact member 26 has a distal end portion provided with an inner surface area 28 which is disposed, as by silver or gold plating, for example, to function as one of the contact surface areas utilized in the closing and opening of switch 10.

Also within housing 12, the terminal 24 is integrally connected adjacent bottom wall 14 to a proximal end portion of a movable contact member 30 which is made of electrically conductive material, such as beryllium copper, for example. The contact member 30 extends elevationally toward the top wall 20 of housing 12 and normally is disposed along its entire length in operational spaced relationship with the fixed contact member 26. Adjacent top wall 20, the movable contact member 30 has a distal end portion provided with an inner surface area 32 which is disposed, as by silver or gold plating, for example, to function as the other one of the contact surface areas utilized in the closing and opening of switch 10. Thus, the contact surface area 32 of movable contact member 30 is normally spaced from the contact surface area 28 of fixed contact member 26; and the switch 10 is maintained in a normally open condition.

The material of movable contact member 30 between the respective opposing side walls 16 and 18 of housing 12 has a thickness, such as about five thousandths of an inch, for example, which is considerably less than the thickness of material for the fixed contact member 26. As a result, the material of movable contact member 30 has the resilient flexibility required, when a laterally directed pressure is applied, for permitting the movable contact member 30 to bend about its proximal end portion adjacent bottom wall 14 without breaking or cracking. Also, the material of movable contact member 30 has the resilient flexibility required, when the pressure is removed, for causing the movable member 30 to spring back toward its initial rest position in operational spaced relationship with the fixed contact member. Thus, the movable contact member 30 is resiliently biased in normal spaced relationship with the fixed contact member 26 for maintaining the switch 10 in a normally open condition.

Between its distal and proximal end portions, the movable contact member 30 is provided with a wave-like projection 34 which extends laterally away from the fixed contact member 26. Projection 34 includes a sloped leading portion 36 disposed adjacent the contact surface area 32: of movable contact member 30. The sloped leading portion 36 is integrally joined to a reverse-sloped trailing portion 37 of projection 34 through an intermediate crest portion 38 thereof. Accordingly, the crest portion 38 is disposed at a greater lateral distance from the fixed contact member 26 than the respective sloped portions 36 and 37 of projection 34.

Extending slidably through the top wall 20 of housing 12 is an elevationally extending shaft 42 of a reciprocally movable actuator 40. The actuator 40 is made of a rigid dielectric material having relatively low-friction surfaces, such as a moldable acetal material, for example. Shaft 42 has a distal end portion disposed externally of housing 12 for carrying a conventional pushbutton 44. Thus, when the pushbutton 44 is pressed downward toward top wall 20, the shaft 42 of actuator 40 slides elevationally through the top wall 20 and into the housing 12.

Within housing 12, the shaft 42 has a proximal end portion integrally joined to an adjacent end of a block-like plunger 46. The plunger 46 is mounted within housing 12 for elevational slidable movement by conventional means, such as providing the plunger 46 with protruding rails (not shown) which extend elevationally of housing 12 and are slidably disposed in generally parallel slots (not shown) molded into adjacent side wall surfaces of housing 12, for example. Plunger 46 has an opposing end portion terminating in a reduced diameter post 47 which extends elevationally of housing 12 and is encircled by one end portion of an axially aligned helical spring 48. The spring 48 is made of resilient material, such as stainless steel, for example, and has an opposing end bearing against the inner surface of bottom wall 14.

Thus, when the pushbutton 44 is pressed with sufficient force to overcome the resilient pressure exerted by spring 48, the shaft 42 slides through top wall 20 and into housing 12 thereby causing the plunger 46 to slide elevationally toward the bottom wall 14 and compress the spring 48. When the pressure is removed from pushbutton 44, the resilient pressure exerted by spring 48 bearing against bottom wall 14 causes the plunger 46 to slide elevationally toward top wall 20 and slide shaft 42 outwardly of housing 12 so as to return pushbutton 44 to its initial rest position. Accordingly, the spring 48 exerts a resilient bias pressure on plunger 46 to maintain it in normal abutting relationship with the top wall 20 and have the shaft 42 support the pushbutton 44 at maximal distance from top wall 20 of housing 12.

The end portion of plunger 46 joined to shaft 42 and normally disposed in abutting relationship with top wall 20 is provided with a cam-like projection 50 which extends from plunger 46 laterally toward the fixed contact member 24. Projection 50 includes a sloped leading surface 52 which conforms generally to the sloped leading portion 36 of projection 34 and normally is disposed in overlying relationship therewith. The sloped leading surface 52 merges into an elevationally extending trailing surface 54 of the projection 50 which is disposed in close-spaced relationship with the distal end portion of movable contact member 30.

There is disposed freely, that is, without forceful frictional engagement, between the respective contact surface areas 28 and 32 when the switch 10 is in the open condition a waferlike barrier component 62 of a dielectric barrier means 60. The barrier component 62 is made of dielectric molded material, such as acetal copolymer material, for example, having sufficient thickness, such as three to four tenths of a millimeter, for example, to prevent the respective contact surfaces areas 28 and 32 from electrically contacting one another when the switch 10 is in the open condition. Dielectric barrier means 60 includes a leg component 64 having one end portion from which the barrier member 62 extends orthogonally in flag-like fashion. The leg component 64 has an opposing end portion which is fixedly secured, as by press fitting in a slot (not shown) in a surface portion of plunger 46 adjacent the side wall 17 of housing 12, for example. Consequently, when the plunger 46 is moved slidably between the respective bottom and top walls 14 and 20 of housing 12, as described, the barrier component 62 is carried elevationally in a corresponding linear direction between the respective contact members 26 and 30.

Accordingly, the barrier component 62 of dielectric barrier means 60 is supported on the plunger 46 in predetermined positional relationship with the cam-like projection 50. As a result, a leading edge portion of the wafer-like barrier component 62 is disposed in spaced lateral relationship with the leading sloped surface 52 of cam-like projection 50 Also, a trailing portion of the wafer-like barrier component 62 is disposed in spaced lateral relationship with the trailing surface 54 of cam-like projection 50 adjacent the juncture with sloped surface 52 thereof.

Figure 3:
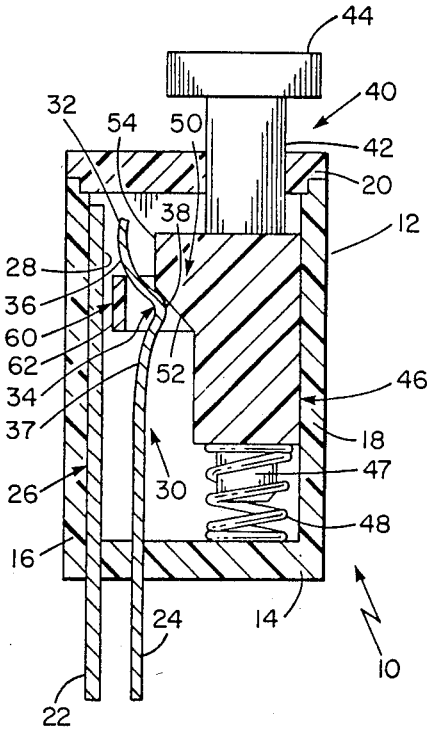
FIG. 3 is an elevational view, partly in section, of the switch shown in FIG. 1 but illustrating a condition of the switch after actuation has commenced and prior to closure of the switch.

Consequently, as shown in FIG. 3, when the pushbutton 44 is initially pressed, the resulting slidable movement of the plunger 46 in the elevational direction toward bottom wall 14 carries the leading sloped surface 52 of cam-like projection 50 into pressure engagement with the leading sloped portion 36 of projection 34. Simultaneously, however, the barrier component 62 of dielectric barrier means 60 is carried in a linear direction corresponding to the elevational movement of plunger 46. As a result, the barrier component 62 is lowered out of the space between the respective contact surface areas 28 and 32 when the movable contact member 30 begins to bend about its proximal end portion adjacent bottom wall 14 and to bring the contact surface area 32 closer to the contact surface area 28.

Figure 4:
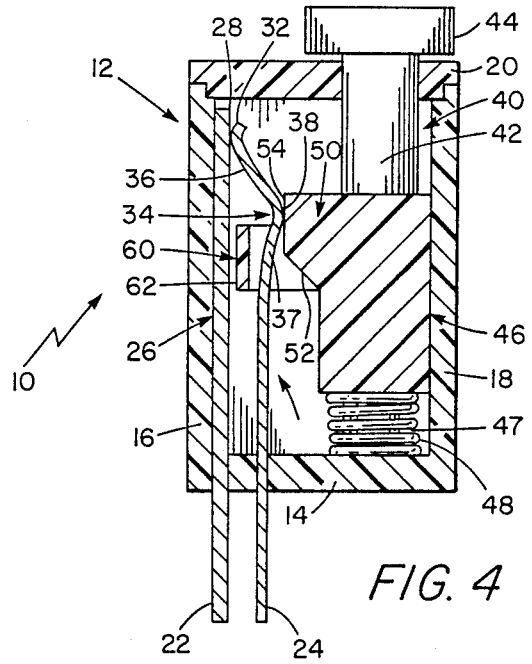
FIG. 4 is an elevational view, partly in section, of the switch shown in FIG. 1 but with the switch disposed in the closed condition.

As shown in FIG. 4, when the pushbutton 44 is fully depressed, the post 47 depending from plunger 48 may butt against the inner surface of bottom wall 14 to serve as a positive limit stop for arresting downward movement of the actuator 40 and compression of spring 48. As a result, when the trailing surface 54 of cam-like projection 50 is carried into full pressure engagement with crest portion 38 of projection 34, the barrier component 62 of dielectric barrier means 60 is disposed in lateral spaced relationship with the trailing portion 37 of projection 34. Consequently, when the barrier component 62 is fully removed from between the respective contact surface areas 28 and 32, the movable contact member 30 is bent sufficiently about its proximal end portion adjacent bottom wall 14 to bring the contact surface 32 into electrical contacting relationship with the contact surface area 28 and close the switch 10.

By studying FIG. 4, FIG. 3 and FIG. 1 in the stated sequence, it may be seen that when pressure is released from the pushbutton 44, the resilient bias pressure exerted by spring 48 on the plunger 46 causes the plunger 46 to slide elevationally toward the top wall 20 of housing 12. As a result, the trailing surface 54 of cam-like projection 50 is moved out of pressure engagement with the crest portion 38 of projection 34 and the sloped leading surface 52 of cam-like projection 50 is brought into pressure engagement with sloped leading portion 36 of projection 34. Consequently, the contact surface area 32 commences to move away from the contact surface area 28 to open switch 10; and the barrier component 62 begins to move elevationally back toward the space between the respective contact surface areas 28 and 32.

When the upper surface of the block-like plunger 46 abuts the top wall 20 of housing 12 and the shaft 42 supports the pushbutton 44 at maximal distance from the top wall 20, the sloped leading surface 52 of cam-like projection 50 is again disposed in overlying relationship with sloped leading portion 36 of projection 34 and no longer exerts a pressure thereon. Consequently, the resilient flexibility of movable contact member 30 causes the contact member 30 to bend back about its proximal end portion adjacent bottom wall 14 and return the contact member 30 toward its initial rest position in operational spaced relationship with the fixed contact member 26.

If the pressure is removed suddenly from pushbutton 44 such that the plunger 46 is snapped upwardly into abutting relationship with top wall 20 of housing 12, then the lateral pressure exerted by cam-like projection 50 on the projection 34 will be removed suddenly. Consequently, the resilient flexibility of movable contact member 30 may return the contact member 30 so rapidly toward its initial rest position that the contact member 30 may oscillate about the initial rest position and tend to bring its contact surface area 32 again into electrical contact relationship with the contact surface area 28 of fixed contact member 26. This condition, generally referred to as "contact bounce" causes an unintentional closing of the switch 10 to occur. However, in accordance with this invention, the barrier component 62 of dielectric barrier means 60 is positioned with respect to the cam-like projection 50 so that when the lateral pressure is removed from the contact member 30 and the respective contact surface areas 28 and 32 are spaced apart, the barrier component 62 is moved back into the space between the respective contact surface areas 28 and 32 before the condition known as "contact bounce" can occur. Thus, the switch 10 is protected against the undersirable effects caused by mechanical vibration or shock of the movable contact member 30.

Accordingly, the barrier component 62 is moved into the space between the respective contact surface areas 28 and 32 after the switch 10 is in the open condition and is moved out of the space between the respective contact surface areas 28 and 32 before the switch 10 is in the closed condition. Consequently, the barrier component 62 need not be an excessively rugged member which may occupy a prohibitively large space, particularly in miniature switches, such as keyboard switches, for example. Rather, the barrier component 62 of this invention is a wafer-like element having only sufficient thickness of dielectric material positionable between the respective contact surface areas 28 and 32 for preventing them from electrically contacting one another when the switch 10 is in the open condition.

Thus, there has been disclosed herein an electrical switch having a fixed contact member and a movable contact member with respective contact surface areas disposed for closing and opening the switch. Also, the switch disclosed herein includes a dielectric barrier means disposable between said respective contact surface areas when the switch is in the open condition for preventing unintentional closing of the switch.

Although the electrical switch shown herein is of the normally open type, the dielectric barrier means disclosed herein may equally well be applied to electrical switches of the closed type. Also, although the electrical switch shown herein is of the pushbutton type, the dielectric barrier means of this invention is readily adaptable for use in other types of switches, such as electrical switches of the toggle type, for example.

From the foregoing, it will be apparent that all of the objectives of this invention have been achieved by the structures shown and described herein. It also will be apparent, however, that various changes may be made by those skilled in the art, without departing from the spirit of the invention as expressed in the appended claims. It is to be understood, therefore, that all matter shown and described herein is to be interpreted as illustrative and not in any limiting sense.

What is claimed is:

1. An electrical switch comprising:

first and second electrical contact means moveable into predetermined electrical contacting relationship with one another for actuated closing of the switch and moveable into spaced apart relationship with one another for actuated opening of the switch; and dielectric barrier means supported for insertion between said first and second electrical contact means subsequent to said contact means being spaced apart a distance greater than the interposed dimension of the dielectric barrier means in said actuated opening of the switch and for removal from between said first and second electrical contact means prior to said contact means being spaced apart a distance equal to the interposed dimension of the dielectric barrier means in said actuated closing of the switch.

2. An electrical switch as set forth in claim 1 wherein said first and second electrical contact means comprises respective first and second electrical contact surfaces and said dielectric barrier means is disposed for vibrational contacting engagement with said first and second electrical contact surfaces.

3. An electrical switch as set forth in claim 1 wherein said dielectric barrier means includes a thickness means disposed between said first and second electrical contact means during said actuated opening of the switch for electrically insulating said contact means from one another.

4. An electrical switch comprising:

first and second electrical conductors having respective first and second contact portions supported in operative relationship with one another, said first electrical conductor being moveable relative to said second electrical conductor and having a first camming portion distinctly located from said first contact portion on said first electrical conductor; and an actuator means supported in operative relationship with said moveable first electrical conductor for actuated closing and actuated opening of said switch, said actuator means including pressure means disposed in cooperative relationship with said first camming portion of the moveable first electrical conductor for pressing said first contact portion thereof into electrical contacting relationship with said second contact portion in said actuated closing of said switch and for permitting a spacing of said first contact portion from said second contact portion in said actuated opening of said switch, and dielectric barrier mean disposed in predetermined positional relationship with said pressure means for insertion between said first and second contact portions in said actuated opening of said switch and for removal from between said first and second contact portions in said actuated closing of said switch simultaneously with said pressure means being disposed for permitting said spacing of said first contact portion from said second contact portion to have an interposed distance value substantially greater than any collinear dimensions of the dielectric barrier means.

5. An electrical switch comprising:

first and second electrical conductors having respective first and second contact portions supported in operative relationship with one another, said first electrical conductor being disposed for relative movement with respect to said second electrical conductor and having a first camming portion distinctly located from said first contact portion on said first electrical conductor; and an actuator supported in operative relationship with said first electrical conductor and including pressure means disposed for engaging said first camming portion of the first electrical conductor and urging said first contact portion thereof into electrical contacting relationship with said second contact portion to close said switch and for permitting relative movement of said first electrical conductor away from said second electrical conductor to form an insulating space between said first and second contact portions and open said switch, said actuator also including dielectric barrier means disposed in predetermined spaced relationship with said pressure means for insertion of said dielectric barrier means into said space between said first and second contact portions subsequent to the forming of said space, said pressure means further including cam-like means disposed for exerting a pressure on said first camming portion of said first electric conductor and causing said urging of said first contact portion thereof, and said dielectric barrier means further including a dielectric component supported on said actuator in predetermined positional relationship with said cam-like means.

* * * * *